US008491405B2

(12) United States Patent
Jorgensen et al.

(10) Patent No.: US 8,491,405 B2
(45) Date of Patent: Jul. 23, 2013

(54) MODULAR GOLF CLUB

(75) Inventors: Douglas C. Jorgensen, San Diego, CA (US); Helene Rick, San Diego, CA (US); Ryan L. Roach, Carlsbad, CA (US); Peter L. Soracco, Carlsbad, CA (US); Eddie Perez, Carlsbad, CA (US)

(73) Assignee: Acushnet Company, Fairhaven, MA (US)

( * ) Notice: Subject to any disclaimer, the term of this patent is extended or adjusted under 35 U.S.C. 154(b) by 544 days.

(21) Appl. No.: 12/760,684

(22) Filed: Apr. 15, 2010

(65) Prior Publication Data

US 2011/0256953 A1 Oct. 20, 2011

(51) Int. Cl.
*A63B 53/04* (2006.01)

(52) U.S. Cl.
USPC ..... 473/288; 473/328; 473/344; 473/349; 473/350

(58) Field of Classification Search
USPC ..... 473/324–350, 287–292; D21/752
See application file for complete search history.

(56) References Cited

U.S. PATENT DOCUMENTS

| | | | | | |
|---|---|---|---|---|---|
| 2,328,583 | A | | 9/1943 | Reach | |
| 2,332,342 | A | | 10/1943 | Reach | |
| 2,530,446 | A | | 11/1950 | Beardsley | |
| 2,774,600 | A | | 12/1956 | Reach | |
| 4,540,178 | A | * | 9/1985 | Johnson et al. | 473/335 |
| 4,630,827 | A | | 12/1986 | Yoneyama | |
| 4,667,963 | A | * | 5/1987 | Yoneyama | 473/348 |
| 4,699,383 | A | | 10/1987 | Kobayashi | |
| 4,883,275 | A | * | 11/1989 | Boone | 473/334 |
| 4,992,236 | A | | 2/1991 | Shira | |
| 5,050,879 | A | | 9/1991 | Sun et al. | |
| 5,190,290 | A | * | 3/1993 | Take | 473/342 |
| 5,275,413 | A | | 1/1994 | Sprague | |
| 5,346,213 | A | | 9/1994 | Yamada | |
| 5,439,223 | A | | 8/1995 | Kobayashi | |
| 5,509,660 | A | | 4/1996 | Elmer | |
| 5,522,593 | A | * | 6/1996 | Kobayashi et al. | 473/349 |
| 5,536,011 | A | * | 7/1996 | Gutowski | 473/350 |
| 5,540,436 | A | * | 7/1996 | Boone | 473/350 |
| 5,776,010 | A | * | 7/1998 | Helmstetter et al. | 473/334 |
| 5,807,186 | A | | 9/1998 | Chen | |
| 5,833,551 | A | * | 11/1998 | Vincent et al. | 473/350 |
| 5,938,540 | A | | 8/1999 | Lu | |
| 6,080,068 | A | | 6/2000 | Takeda | |
| 6,290,609 | B1 | * | 9/2001 | Takeda | 473/335 |
| 6,554,719 | B2 | * | 4/2003 | Peters et al. | 473/291 |
| 6,569,029 | B1 | | 5/2003 | Hamburger | |
| 6,592,468 | B2 | * | 7/2003 | Vincent et al. | 473/334 |
| 6,929,563 | B2 | * | 8/2005 | Nishitani | 473/334 |
| 7,022,027 | B2 | * | 4/2006 | Chen | 473/291 |
| 7,144,336 | B2 | * | 12/2006 | Reyes et al. | 473/342 |
| 7,530,902 | B2 | * | 5/2009 | Nakamura | 473/334 |
| 7,604,550 | B1 | | 10/2009 | Currie | |
| 7,749,100 | B2 | * | 7/2010 | Tavares et al. | 473/332 |
| 7,988,565 | B2 | * | 8/2011 | Abe | 473/328 |

* cited by examiner

*Primary Examiner* — Sebastiano Passaniti
(74) *Attorney, Agent, or Firm* — Michael J. Mancuso

(57) ABSTRACT

The present invention is directed to a modular golf club. In particular, a golf club includes a plurality of components that are removably coupled so that the physical attributes of the golf club head may be tuned. The inventive golf club head includes a body member and at least one of a removable sole member and a removable face member.

12 Claims, 7 Drawing Sheets

MODULAR GOLF CLUB

FIELD OF THE INVENTION

This invention generally relates to golf clubs, and more specifically to the sole configuration of iron-type golf clubs.

BACKGROUND OF THE INVENTION

Iron-type golf clubs generally include a face that includes a ball striking surface and a body that supports the face, provides desired mass properties and includes a sole that is configured to contact the ground during a swing. The face includes a ball striking surface that generally includes a plurality of score lines or grooves that are positioned to impart spin on the ball during impact. The body is generally designed to provide mass that is distributed to tailor the behavior of the club, especially during impact with the ball. The sole configuration also dictates the behavior of the club caused by its interaction with the ground at address and during a swing.

Each golfer has a unique swing. It is impossible to design a golf club that is perfectly suited to every golfer. However, golf club designers are forced to provide a limited number of models that are intended to suffice for the majority of golfers. Typically, the construction of the golf club, especially for iron-type golf clubs, includes a single structural component that includes the body, the face, the sole and a hosel. In multi-material constructions, the parts of the golf club head are formed separately and then coupled during manufacturing of the club head.

Prior golf clubs have utilized multi-component constructions. For example, U.S. Pat. No. 5,346,213 describes a golf club head that includes a metal head body and a fiber reinforced resin face plate. A support pin extends through the body and retains the face plate.

In another multi-component golf club head construction, shown in U.S. Pat. No. 6,080,068, a golf club head includes a head attachment portion at the rear of a face that is horizontally connected to a base of a shaft attachment portion.

There is a need for an improved golf club construction that provides greater ability to alter the physical attributes of the golf club head.

SUMMARY OF THE INVENTION

The present invention is directed to modular golf clubs. The inventive golf club includes a multi-component construction that includes removable components.

In an embodiment, a golf club includes a body member, a face member, a sole member, and a plurality of mechanical fasteners. The body member defines a sole cavity and includes a hosel. The face member is coupled to the body member and defines a ball-striking surface. The sole member includes a bounce surface and is received in the sole cavity so that the bounce surface is exposed and forms a lower most location of the golf club. The mechanical fasteners couple the face member and the sole member to the body member, and at least one of the mechanical fasteners couples the face member and the sole member to the body member such that the body member is sandwiched therebetween.

In another embodiment, a golf club includes a body member, a sole member, and at least one mechanical fastener. The body member includes an upper portion, a muscle portion, and a hosel, and the body member defines a cavity disposed in the muscle portion. The sole member is disposed in the cavity. The mechanical fastener couples the sole member to the body member. The sole member is slid into the cavity in the body member in a direction parallel to a ball-striking surface from a leading edge toward a top line.

In a still further embodiment, a golf club includes a body member, a sole member, and a plurality of mechanical fasteners. The body member includes an upper portion, a muscle portion, a hosel and a channel extending through the muscle portion. The channel is defined by a heel side channel wall, a toe side channel wall and a base channel wall. The sole member is disposed in the channel and includes a heel side wall, a toe side wall and a base wall that abuts the base channel wall. The heel side wall is angled relative to the heel side channel wall to form a heel side angular gap, and the toe side wall is angled relative to the toe side channel wall to form a toe side angular gap. The mechanical fasteners couple the sole member to the body member and a first fastener extends across the heel side angular gap and a second fastener extends across the toe side angular gap.

BRIEF DESCRIPTION OF THE DRAWINGS

In the accompanying drawings, which form a part of the specification and are to be read in conjunction therewith and in which like reference numerals are used to indicate like parts in the various views.

DETAILED DESCRIPTION OF THE PREFERRED EMBODIMENTS

The present invention is directed to modular golf clubs. In particular, the inventive golf clubs generally include a multi-component structure that allows various attributes to be altered.

Other than in the operating examples, or unless otherwise expressly specified, all of the numerical ranges, amounts, values and percentages such as those for amounts of materials, moments of inertias, center of gravity locations, loft and draft angles, and others in the following portion of the specification may be read as if prefaced by the word "about" even though the term "about" may not expressly appear with the value, amount, or range. Accordingly, unless indicated to the contrary, the numerical parameters set forth in the following specification and attached claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Furthermore, when numerical ranges of varying scope are set forth herein, it is contemplated that any combination of these values inclusive of the recited values may be used.

Figure 1:
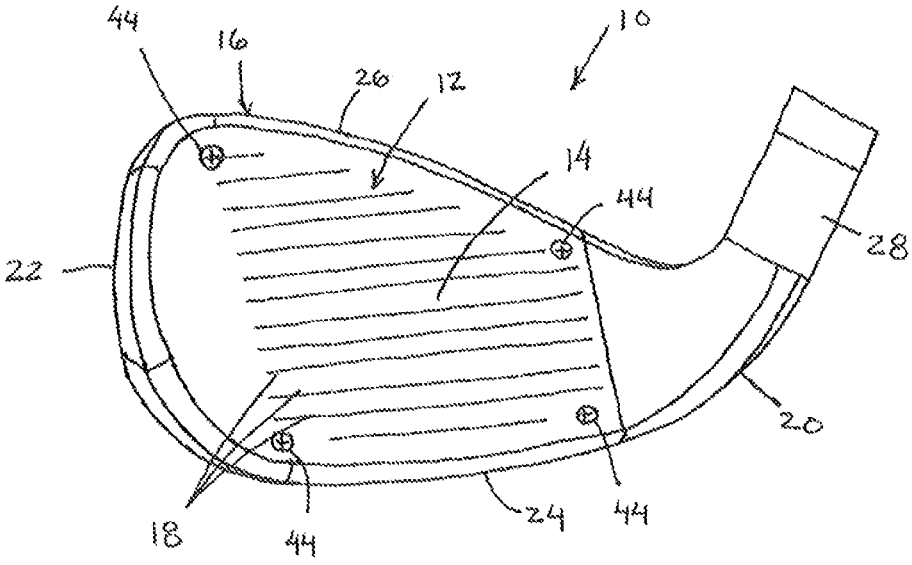
FIG. 1 is a front perspective view of a golf club head in accordance with the present invention.
Figure 2:
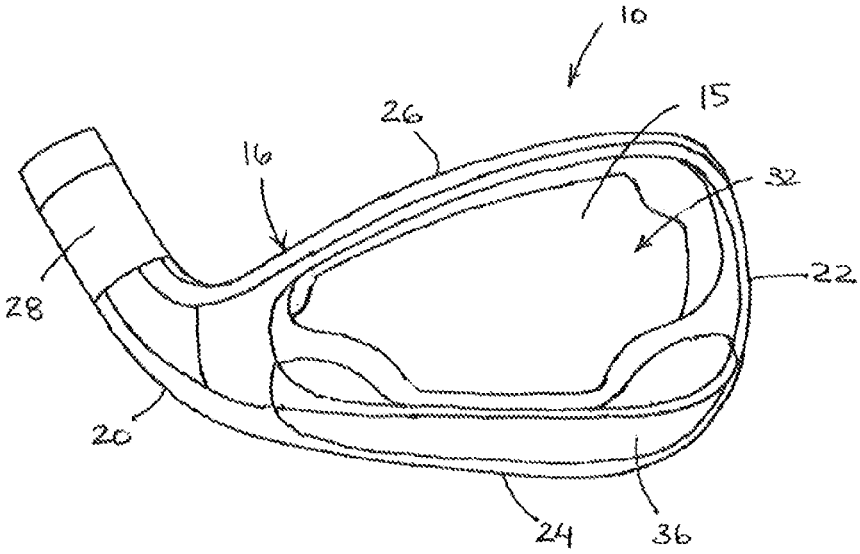
FIG. 2 is a rear perspective view of the golf club head of FIG. 1.
Figure 3:
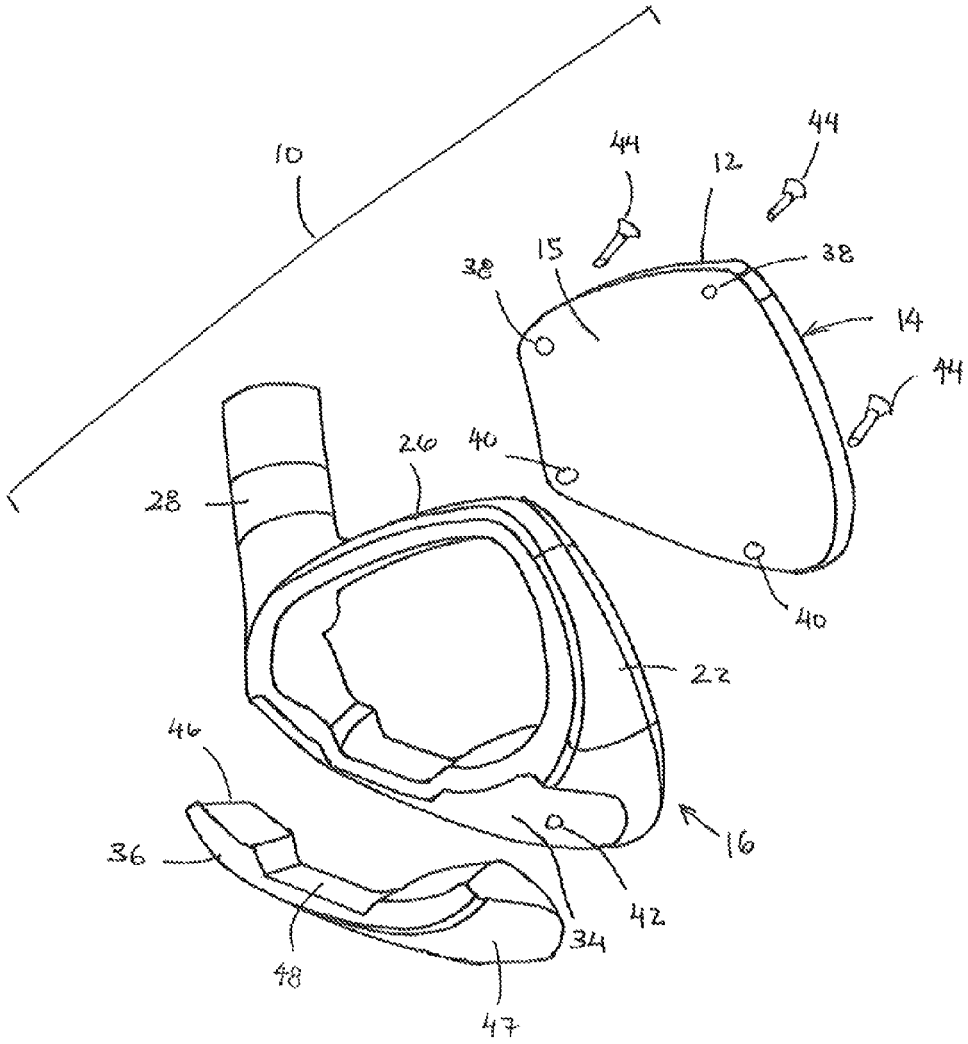
FIG. 3 is an exploded view of the golf club head of FIG. 1.

Referring to FIGS. 1-3, an iron-type golf club head 10 generally includes a face 12 and a body 16 that supports face 12. Face 12 includes a generally planar ball striking surface 14 and a plurality of score lines 18, or grooves, that extend into face 12 from ball striking surface 14. Score lines 18 assist in imparting spin to a golf ball during impact and may have various configurations to produce desired spin characteristics.

Body 16 provides the majority of the mass of club head 10 and is configured to distribute the mass so that club head has a desired behavior during impact with a golf ball and/or the ground during a swing. For example, body 16 may have a muscle-back or a cavity-back configuration so that the forgiveness and playability may be tuned. As shown, body 16 has a cavity-back configuration that provides perimeter weighting to increase the moment of inertia of club head 10 to add forgiveness during misaligned ball impacts. In particular, the mass of body 16 is concentrated in locations spaced from the geometric center of club head 10, such as in a heel portion 20 and a toe portion 22. Additionally, the mass of body 16 is concentrated below the geometric center in a sole portion 24 and above the geometric center in a top line portion 26, with a greater percentage of the mass located in sole portion 24 so that the height of the center of gravity of club head 10 is reduced. Body 16 also includes a hosel 28 for attaching a golf club shaft.

A back plate may also be attached to body 16. The back plate may be coupled to any portion of body 16, such as within a back cavity 32 that is defined by the perimeter weighting of body 16 and a rear surface 15 of face 12. The back plate may be constructed to provide weight adjustment, vibration damping and/or desired aesthetics as will be described in greater detail below. [multi-material, etc]

Sole portion 24 of golf club head 10 may also include a sole member 36 that is constructed separate from body 16 and coupled thereto. For example, body 16 includes a sole cavity 34 that is configured to receive a sole member 36. Sole member 36 is shaped to complement the shape of sole cavity 34. For example, sole member 36 includes a heel portion 46 and a toe portion 47 that are each generally more voluminous than a necked down central portion 48. The shape is generally preferred so that the moment of inertia may be altered more efficiently by altering the mass properties of the sole member such as by including weight inserts or cavities in selected portions of the sole member 36.

As shown, sole member 36 is removably coupled to body 16 using removable mechanical fasteners 44 that extend through body 16. Preferably, the removable fasteners couple both sole member 36 and face 12 to body 16 so that body 16 is sandwiched therebetween. In the present embodiment, a plurality of apertures is included in face 12 and the apertures preferably receive threaded fasteners that extend into body 16. For example, upper apertures 38 extend through face 12 and align with threaded bores included in body 16. Lower apertures 40 extend through face 12 and align with apertures 42 of body 16 and threaded bores included in sole member 36.

Face 12, body 16 and sole member 36 may be constructed from any metal or non-metal material. Suitable materials for the components include metallic materials such as aluminum, stainless steel, carbon steel, titanium, magnesium, and alloys thereof; and non-metallic materials such as carbon fiber composites, plastics and fiber reinforced plastics. Additionally, face 12 may be constructed so that it may be disposable such as by having a selected wear rate that requires the face to be replaced after a predetermined amount of use. Suitable materials for body 16 include, but are not limited to, stainless steel, carbon steel, titanium, aluminum and alloys thereof and portions may be constructed from materials having greater density such as lead, tungsten, gold, or silver to provide a desired mass distribution.

Figure 4:
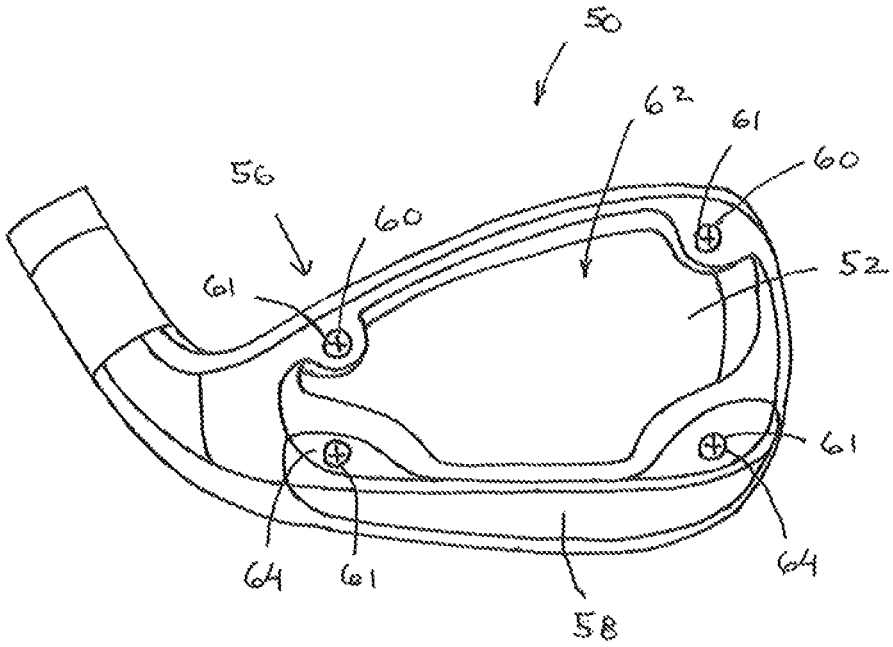
FIG. 4 is a rear view of another embodiment of a golf club head in accordance with the present invention.

In another embodiment, shown in FIG. 4, a golf club head 40 includes an alternative configuration of the fastening features for a face 52, a body 56 and a sole member 58. In particular, the fastening features are oriented so that they are not visible on the ball striking surface of the golf club head. For example, body 56 includes a plurality of apertures 60 located generally around a back cavity 62 of the golf club head that are configured to receive fasteners 61. Sole member 58 also includes apertures 64 that are aligned with corresponding apertures in body 56 and are configured to receive fasteners 61. Face 52 includes a plurality of threaded bores that are engaged by the fasteners to retain face 52 and sole member 58 coupled to body 56.

A plurality of sole members and faces may be provided and removably coupled to the body so that a plurality of configurations of the golf club head may be created. Combinations of a face and a sole member may be provided so that the overall mass of the golf club head may be held constant while the mass is shifted to different portions of the golf club head. For example, a combination having a lightweight face and a heavy sole member may be provided in addition to a combination having a heavy face and a lightweight sole member while each combination has the same overall mass.

Figure 5:
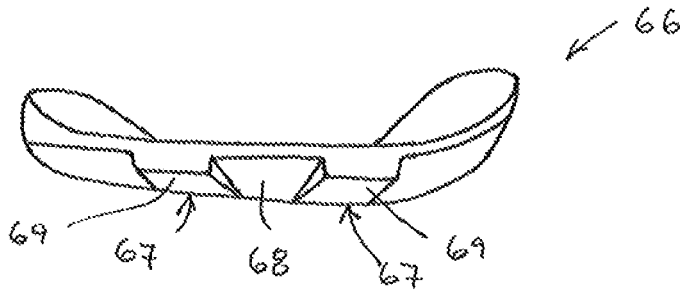
FIG. 5 is a rear view of an embodiment of a sole member included in a golf club head of the present invention.
Figure 6:
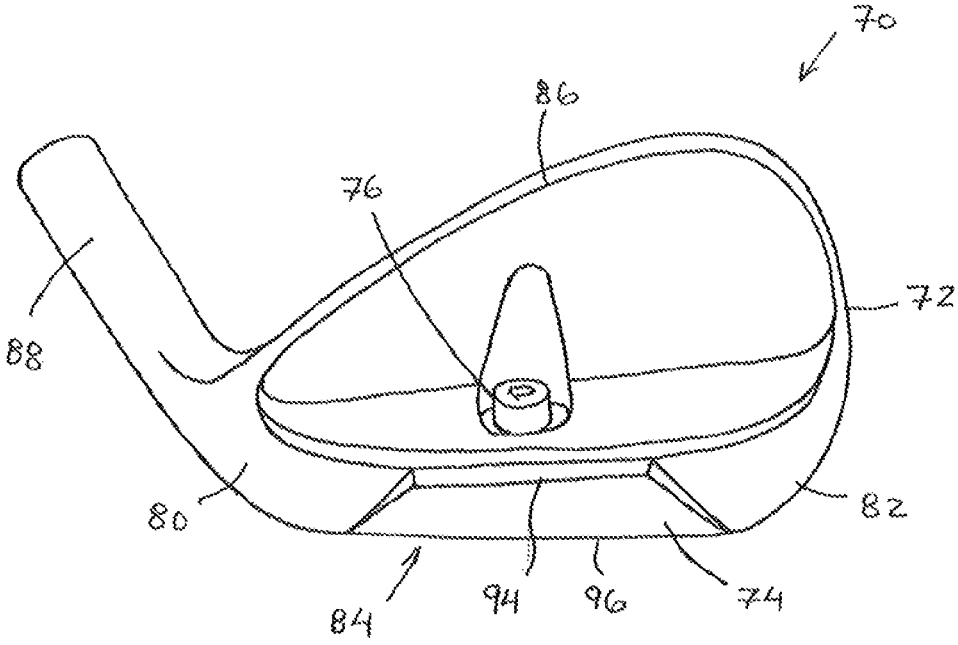
FIG. 6 is a rear view of another embodiment of a golf club head in accordance with the present invention.
Figure 7:
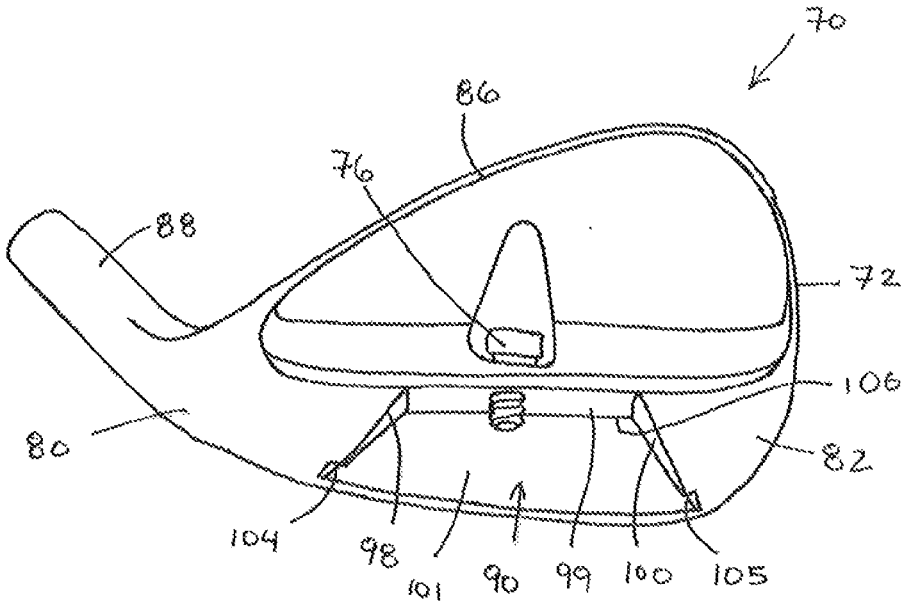
FIG. 7 is a rear view of a portion of the golf club head of FIG. 6.
Figure 8:
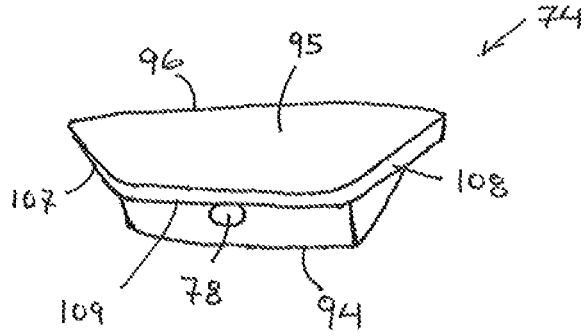
FIG. 8 is a side view of a sole member of the golf club head of FIG. 6.
Figure 9:
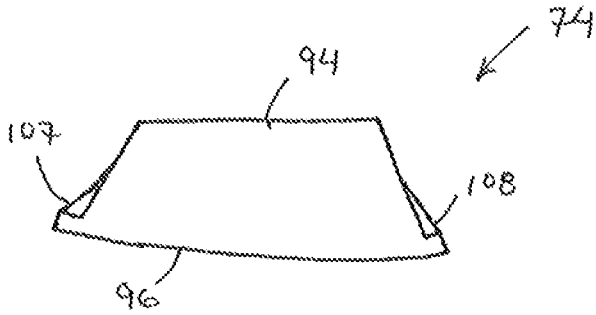
FIG. 9 is another side view of the sole member of FIG. 8.

Additionally, a plurality of sole members may be provided having different masses and/or weight ports or cavities so that mass may be added or removed from the golf club head. Furthermore, a plurality of sole members may be provided having different shapes including bounce surfaces, heel/toe relief, and camber. In another example, shown in FIG. 5, sole member 66 provides an alternative bounce surface that includes a plurality of rails 67 separated by a central depression 68. In the illustrated embodiment, the rails 67 converge from the trailing edge to a front edge of the sole member. Rails 67 are positioned so that they are approximately equidistant from the heel to toe center of the sole of the golf club head. Each rail 67 defines a ground contact surface 69 that is offset relative to the remainder of the sole member so that when sole member 66 is installed in a golf club and the golf club is placed at address, the ground contact surfaces define the lowest portions of the golf club. It should be appreciated that any number of rails may be included in the sole member, or the sole member may include a single rail that may further be located centrally on the sole member. Moreover, the rails need not be convergent toward the leading edge, and may alternatively be divergent in that direction or parallel in a forward/aft direction. Additionally, rather than including rails, the sole member may only include one or more depressions so that portions of the lower sole surface are offset toward a top line portion of the club head relative to the remainder of the lower sole surface.

Moreover, a plurality of different faces may be provided that include a plurality of different configurations. The configurations may alter any attribute of the face and/or the club head, such as spin generation and mass distribution. For example, the plurality of different faces may have different masses, hardness, groove configurations, materials, machine patterns, roughness, coatings and/or surface treatments.

Moreover, a plurality of bodies may be provided. The plurality of bodies provide alternative configurations for various physical attributes. Those physical attributes include the amount of offset, loft, lie, bounce, sole width/shape, mass distribution, hosel length, topline thickness, etc.

Referring now to FIGS. 6-9, another embodiment of a golf club including a removable sole member will be described. In the present embodiment, golf club head 70 has a muscle-back configuration and includes a body 72, a sole member 74 and a fastener 76. Fastener 76 extends through an aperture included in body 72 and engages a bore 78 included in sole member 74 so that sole member 74 is releasably coupled to body 72.

In the muscle-back configuration of golf club head 70, the mass of body 72 is generally distributed more evenly horizontally across the club head from a heel portion 80 to a toe portion 82 compared to the previously described cavity-back configuration. However, the mass of body 72 is concentrated vertically below the geometric center in a muscle portion of the club head that includes a sole portion 84. Above the muscle portion, in the upper portion of the golf club head, the mass of body 72 is evenly distributed to a top line portion 86. Body 72 also includes a hosel 88 for attaching a golf club shaft.

The muscle portion of the golf club head is configured to receive and to be removably coupled to sole member 74. In particular, a portion of the muscle back portion is configured to provide a receptacle for sole member 74. The receptacle is generally defined by a heel side wall 98, a toe side wall 100, a top wall 99 and a base wall 101 and is formed as a tapered slot 90 that is tapered so that it narrows toward top wall 99 and fastener 76. Slot 90 also includes a peripheral undercut formed by a plurality of undercuts 104, 105, 106. Preferably, the undercuts are aligned in a plane that is parallel to a ball-striking face of golf club 70.

Sole member 74 is shaped to complement the shape of the receptacle, slot 90. In particular, sole member 74 is generally wedge-shaped and includes side walls that generally converge from a leading edge 96 to a trailing edge 94. In the present embodiment, slot 90 and sole member 74 are shaped so that as fastener 76 is tightened, sole member 74 is drawn into forcible abutment with a heel side wall 98 and a toe side wall 100 of slot 90.

A plurality of flanges, including heel flange 107, toe flange 108, and top flange 109 are included on sole member 74 that slidably engage the peripheral undercuts of slot 90. In the illustrated embodiment, the undercuts of slot 90 and the flanges of sole member 74 are oriented so that sole member 74 is slidably received in slot 90 in a direction from the leading edge to the top line and parallel to the ball-striking face so that base wall 101 of slot 90 slides against a base wall 95 of sole member 74. It should be appreciated that the undercuts and flanges may be provided around any portion of the perimeters of the slot and the sole member. As shown, those features are located on the heel side, the toe side and the top side of the slot and sole member, but it should be appreciated that they may be included on only the heel and/or toe sides or only on the top side if desired.

Preferably, the interface between sole member 74 and slot 90 is selected to minimize the forces placed on fastener 76 during use of the golf club. In particular, the interface is configured so that during impact between the golf club and the playing surface and between the golf club and a golf ball the forces are predominantly transferred directly between body 72 and sole member 74, rather than through fastener 76. For example, the engagement of the undercuts and flanges provide a direct load path between the sole member and the body.

Figure 10:
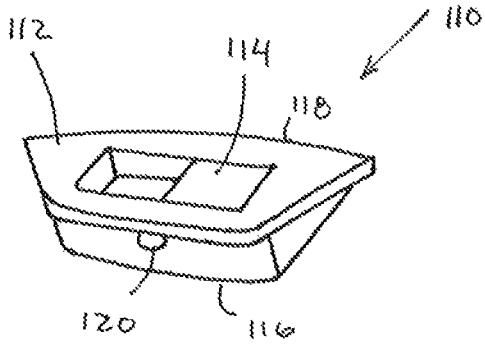
FIG. 10 is an alternative embodiment of a sole member that may be included in the golf club head of FIG. 6.

The sole member may be constructed as a single, homogeneous component or it may have a multi-piece and/or multi-material construction. In another example, shown in FIG. 10, a sole member 110 includes a multi-piece and multi-material construction. Generally, sole member 110 includes a body member 112 and an insert 114.

Sole member 110 is shaped to complement the shape of slot 90 of body 72. In particular, sole member 110 is generally wedge-shaped and has an overall fore to aft width that generally decreases from a trailing edge 116 to a leading edge 118 and an overall heel to toe length that generally increases from trailing edge 116 to leading edge 118. In the present embodiment, slot 90 and sole member 110 are shaped so that as fastener 76 is tightened in bore 120, sole member 110 is drawn into forcible abutment with a heel side surface 98 and a toe side surface 100 of slot 90.

Figure 11:
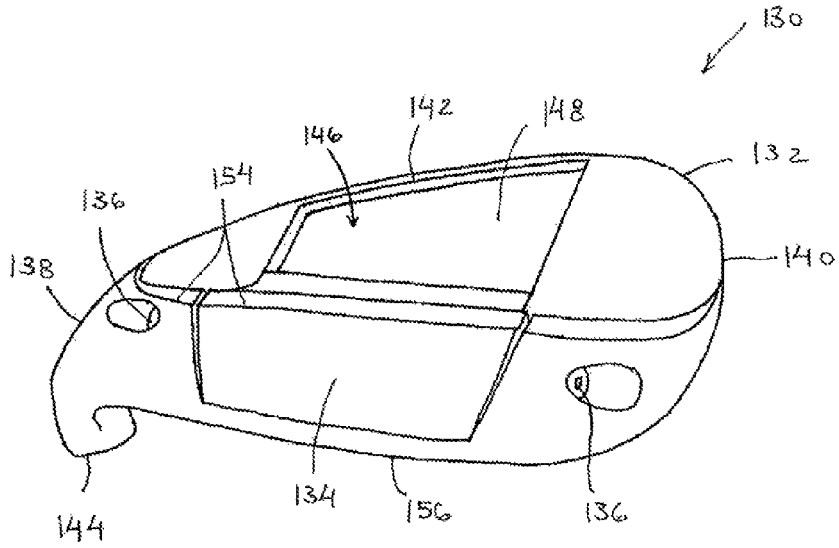
FIG. 11 is a rear perspective view of another embodiment of a golf club head in accordance with the present invention.
Figure 12:
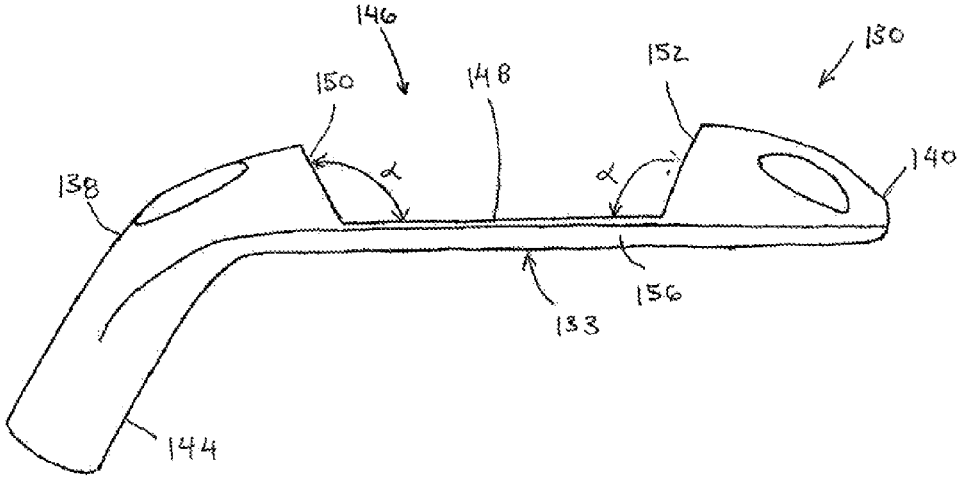
FIG. 12 is a side view of a portion of the golf club head of FIG. 11.
Figure 13:
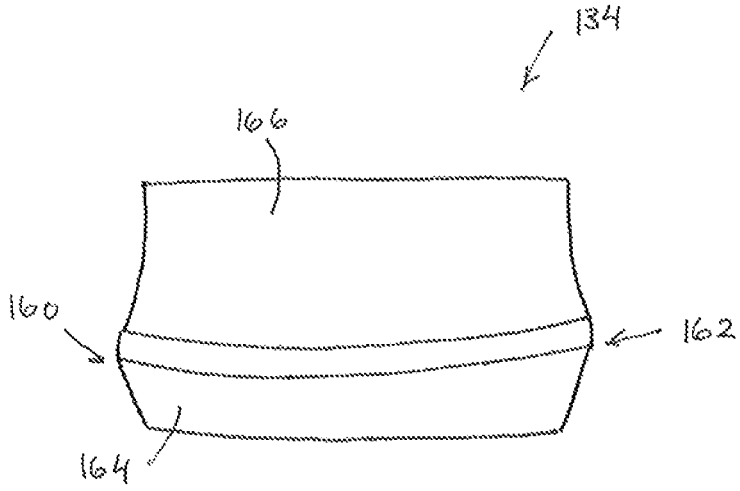
FIG. 13 is a side view of a sole member of the golf club head of FIG. 11.
Figure 14:
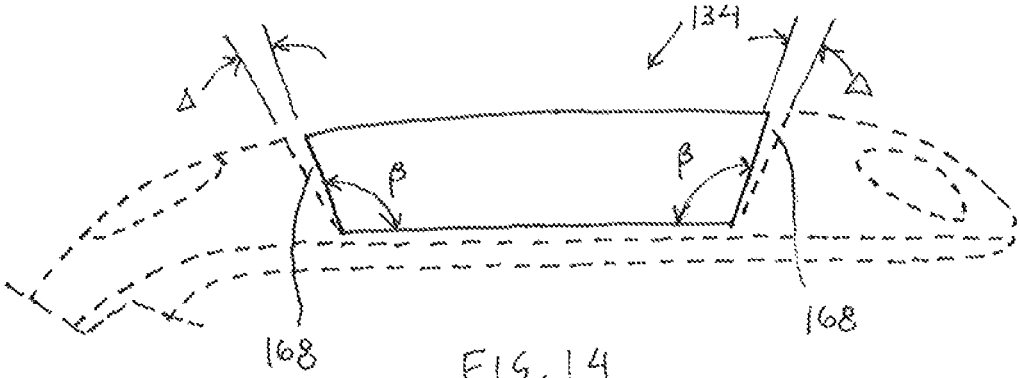
FIG. 14 is another side view of the sole member of FIG. 13.
Figure 15:
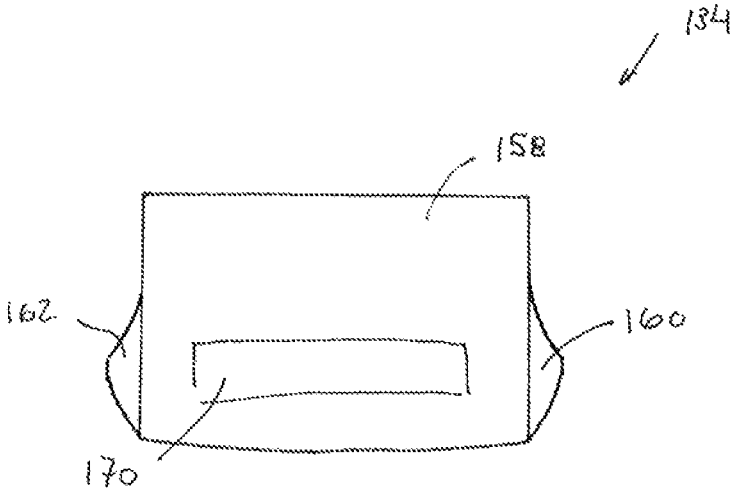
FIG. 15 is another side view of the sole member of FIG. 13.

Referring now to FIGS. 11 and 12, a golf club head 130 has a muscle-back configuration and includes a body 132 having a ball striking surface 133, an insert (e.g., sole member 134) and a plurality of fasteners 136. Each of fasteners 136 extends through an aperture included in body 132 and engages a bore included in sole member 134 so that sole member 134 is releasably coupled to body 132.

In the muscle-back configuration of golf club head 130, the mass of body 132 is generally distributed more evenly horizontally across the club head from a heel portion 138 to a toe portion 140 compared to the previously described cavity-back configuration. However, the mass of body 132 is concentrated vertically below the geometric center in a muscle portion of the club head that includes a sole portion 134. Above the muscle portion, in the upper portion of the golf club head, the mass of body 132 is evenly distributed to a top line portion 142. Body 132 also includes a hosel 144 for attaching a golf club shaft.

The muscle portion of the golf club head is configured to receive and to be coupled to sole member 134. In particular, a portion of the muscle back portion is removed to provide a receptacle for sole member 134. The receptacle is formed as a channel 146 that extends through the muscle back portion and a portion of the upper portion of the golf club toward top line portion 142.

Channel 146 is formed by a base wall 148, a heel side wall 150 and a toe side wall 152. Base wall is a substantially planar wall that is approximately parallel with ball striking surface 133. Heel side wall 150 and toe side wall 152 are each angled relative to base wall 148 so that channel is wider in a heel to toe direction at a trailing edge 154 of the golf club head than adjacent a leading edge 156 so that they each define a draft angle $\alpha$, shown in FIG. 12.

Sole member 134 is received within channel 146 and is coupled to body 132 using fasteners 136. Sole member 134 includes a base wall 158, a heel side wall 160, a toe side wall 162, a sole wall 164, and an aft wall 166. Base wall 158 forms a generally curved or planar surface that abuts base wall 148 of channel 146 when sole member 134 is engaged with body 132. Each of heel side wall 160 and toe side wall 162 is angled relative to base wall 158 by an angle β. Preferably, angle 0 has a magnitude that is less than the magnitude of angle a so that there is an angled gap 168 having an angle Δ, corresponding to the difference between angles α and β , between the adjacent side walls of sole member 134 and channel 146. Fasteners 136 are oriented in a heel to toe direction so that tightening fasteners 136 reduces the size of gap 168 and places the ball-striking surface 133 in tension. In embodiments utilizing a curved base wall 148, the wall is preferably cylindrical. In the present embodiment, tension is applied across the face in a heel to toe direction, but it should be appreciated that the receptacle and the insert may be oriented to provide any desired tension orientation.

The insert may include features to alter the mass of the insert while providing an outer profile that matches the remainder of the golf club head body. For example, sole member 134 includes a weight insert 170 that increases the mass of sole member 134 so that golf club head 130 has a desired overall mass. It should be appreciated that any mass altering features may be included, such as weights and cavities so that the mass of the insert may be increased or reduced.

The apertures included in body 132 that receive fasteners 136 extend generally in a heel to toe direction and intersect channel 146.

While it is apparent that the illustrative embodiments of the invention disclosed herein fulfill the objectives stated above, it is appreciated that numerous modifications and other embodiments may be devised by those skilled in the art. Elements from one embodiment can be incorporated into other embodiments. Therefore, it will be understood that the appended claims are intended to cover all such modifications and embodiments, which would come within the spirit and scope of the present invention.

We claim:

1. A golf club, comprising:

a body member including an upper portion, a muscle portion, and a hosel, wherein the body member defines a cavity disposed in the muscle portion;

a sole member disposed in the cavity; and at least one mechanical fastener coupling the sole member to the body member, wherein the sole member is slid into the cavity in the body member in a direction parallel to a ball-striking surface from a leading edge toward a top line, and wherein the cavity includes a heel side wall that includes a first lateral undercut extending toward a heel of the body member and a toe side wall that includes a second lateral undercut extending toward a toe of the body member, and the sole member includes a heel wall that includes a first lateral flange that slides into the first lateral undercut and a toe wall that includes a second lateral flange that slides into the second lateral undercut.

2. The golf club of claim 1, wherein the cavity includes a top wall that includes a top undercut and the sole member includes a top wall that includes a top flange that engages the top undercut.

3. The golf club of claim 1, wherein the at least one fastener extends through a portion of the body member and engages a top wall of the sole member.

4. The golf club of claim 1, wherein sole member defines a sole member cavity that is enclosed by the body member.

5. The golf club of claim 4, wherein the sole member comprises a sole member body and a sole insert, and the insert is disposed within the sole member cavity and is constructed from a material that is different than the sole member body.

6. A golf club, comprising:

a body member including an upper portion, a muscle portion, a hosel and a channel extending through the muscle portion, wherein the channel is defined by a heel side channel wall, a toe side channel wall and a base channel wall;

a sole member disposed in the channel and including a heel side wall, a toe side wall and a base wall, wherein the base wall abuts the base channel wall, wherein the heel side wall is angled relative to the heel side channel wall to form a heel side angular gap, and wherein the toe side wall is angled relative to the toe side channel wall to form a toe side angular gap; and a plurality of mechanical fasteners coupling the sole member to the body member, wherein a first fastener extends across the heel side angular gap and a second fastener extends across the toe side angular gap.

7. The golf club of claim 6, wherein the base channel wall is planar and the base wall of the sole member is convex.

8. The golf club of claim 7, wherein the base wall of the sole member is cylindrical.

9. The golf club of claim 6, wherein the channel extends through at least a portion of the upper portion of the body member toward a top line of the golf club head.

10. The golf club of claim 6, wherein the body member is constructed of a first material and the sole member is constructed from a second material having a density that is less than a density of the first material.

11. The golf club of claim 6, wherein the body member is constructed of a first material and the sole member is constructed from a second material having a density that is greater than a density of the first material.

12. The golf club of claim 6, wherein the sole member comprises a sole member body and a sole insert, and the insert is constructed from a material that is different than the sole member body.

* * * * *